US007448239B1

(12) United States Patent
Huang et al.

(10) Patent No.: US 7,448,239 B1
(45) Date of Patent: Nov. 11, 2008

(54) LOCK ASSEMBLY

(75) Inventors: Chao-Ming Huang, Kaohsiung Hsien (TW); Chi-Ming Chen, Kaohsiung Hsien (TW)

(73) Assignee: Taiwan Fu Hsing Industrial Co., Ltd. (TW)

( * ) Notice: Subject to any disclaimer, the term of this patent is extended or adjusted under 35 U.S.C. 154(b) by 0 days.

(21) Appl. No.: 12/004,526

(22) Filed: Dec. 21, 2007

(30) Foreign Application Priority Data

May 11, 2007 (TW) ..... 96116784 A

(51) Int. Cl.
*E05B 27/04* (2006.01)
*E05B 29/04* (2006.01)

(52) U.S. Cl. ..... 70/360; 70/340; 70/341; 70/383; 70/384; 70/492; 70/493; 70/495

(58) Field of Classification Search ..... 70/360, 70/361, 337–343, 368, 382–385, 492–496
See application file for complete search history.

(56) References Cited

U.S. PATENT DOCUMENTS 1,965,889 A * 7/1934 Fitz ..... 70/419
3,667,262 A * 6/1972 Hill ..... 70/384
4,376,382 A * 3/1983 Raymond et al. ..... 70/338
6,119,495 A * 9/2000 Loreti ..... 70/340
6,959,569 B2 * 11/2005 Strader et al. ..... 70/492
6,973,813 B2 * 12/2005 Erdely ..... 70/492
7,007,528 B2 * 3/2006 Chong et al. ..... 70/492
7,047,778 B2 * 5/2006 Dimig et al. ..... 70/495
7,162,901 B2 * 1/2007 Williams ..... 70/493
7,308,811 B2 * 12/2007 Armstrong et al. ..... 70/492
7,322,219 B2 * 1/2008 Armstrong et al. ..... 70/492
7,360,382 B2 * 4/2008 Fernandez ..... 70/360
2003/0089149 A1 * 5/2003 Suzuki et al. ..... 70/492
2004/0069030 A1 * 4/2004 Takadama ..... 70/495
2005/0011242 A1 1/2005 Armstrong et al.
2005/0016234 A1 * 1/2005 Strader et al. ..... 70/492
2005/0172687 A1 * 8/2005 Segien et al. ..... 70/493
2006/0117822 A1 * 6/2006 Boesel et al. ..... 70/495
2007/0101782 A1 * 5/2007 Shen ..... 70/495

* cited by examiner

*Primary Examiner*—Lloyd A Gall
(74) *Attorney, Agent, or Firm*—William E. Pelton, Esq.; Cooper & Dunham LLP

(57) ABSTRACT

A lock assembly has a housing, a lock cylinder, an adjusting block and multiple rack assemblies. The adjusting block is slidably received in the lock cylinder and has a wedge side facing the lock cylinder and a plurality of first wedge elements formed on the wedge side. The rack assemblies are slidably received respectively in the lock cylinder. Each rack assembly has a rack element, an adjusting base and a resilient member arranged between the rack element and the adjusting base. Each rack element and each adjusting base have a plurality teeth formed thereon and detachably engaged each other respectively. Each rack element has a second wedge element that is selectively engaged or disengaged from one of the first wedge elements on the adjusting block.

18 Claims, 17 Drawing Sheets

LOCK ASSEMBLY

BACKGROUND OF THF INVENTION

1. Field of the Invention

The present invention relates to a lock assembly, and more particularly to a lock assembly that can be adjusted to fit with different keys conveniently and quickly.

2. Description of Related Art

A traditional lock assembly is only applied with a specific key and cannot fit with different keys. To use with different keys, an old lock cylinder should be replaced with a new one, such that the traditional lock assembly is not versatile in use.

To make a lock assembly fitting with different keys, a US patent application with publish number 2005/0011242 (referring to '242 application hereafter), entitled to "Rekeyable Lock Assembly" is provided. The '242 application comprises a plug body and carrier sub-assembly mounted in a lock cylinder body. The carrier sub-assembly is mounted on the plug body and comprises a carrier and a plurality of racks.

To adjust the lock cylinder to fit with different keys, an original corresponding key is inserted into the plug body and the plug body is rotated 90° in clockwise to make the carrier slidable in the lock cylinder body between two positions. A tool is then inserted into the plug body to push the carrier with the racks to move in an axial direction and disengage from pins in the lock cylinder body. After removing the original corresponding key and the tool from the plug body, a new key is inserted into the lock cylinder body and is rotated in counterclockwise to make the racks engaging the pins again. Consequently, the lock assembly can fit with the new corresponding key.

However, a specific tool is need for adjusting the lock assembly of the '242 application, and the tool is not an inherent part of the lock assembly. Therefore, the adjustment of the lock assembly of the '242 application is troublesome and time-consuming.

To overcome the shortcomings, the present invention tends to provide a lock assembly to mitigate or obviate the aforementioned problems.

SUMMARY OF THE INVENTION

The main objective of the invention is to provide a lock assembly that can be adjusted to fit with different keys conveniently and quickly.

The lock assembly comprises a housing, a lock cylinder, an adjusting block and multiple rack assemblies. The housing has a cylinder hole defined axially through the housing. The lock cylinder is rotatably and slidably received in the cylinder hole of the housing and has a key hole, a plurality of pin slots and a holding recess. The pin slots and the holding recess are communicating with the key hole of the lock cylinder. The adjusting block is slidably received in the holding recess of the lock cylinder and has a wedge side facing the lock cylinder and a plurality of first wedge elements formed on the wedge side. The rack assemblies are slidably received respectively in the pin slots in the lock cylinder. Each rack assembly comprises a rack element, an adjusting base and a resilient member arranged between the rack element and the adjusting base. Each rack element and each adjusting base have a plurality teeth formed thereon and detachably engaged each other respectively. Each rack element has a second wedge element that is selectively engaged or disengaged from one of the first wedge elements on the adjusting block.

Other objects, advantages and novel features of the invention will become more apparent from the following detailed description when taken in conjunction with the accompanying drawings.

DETAILED DESCRIPTION OF PREFERRED EMBODIMENT

Figure 1:
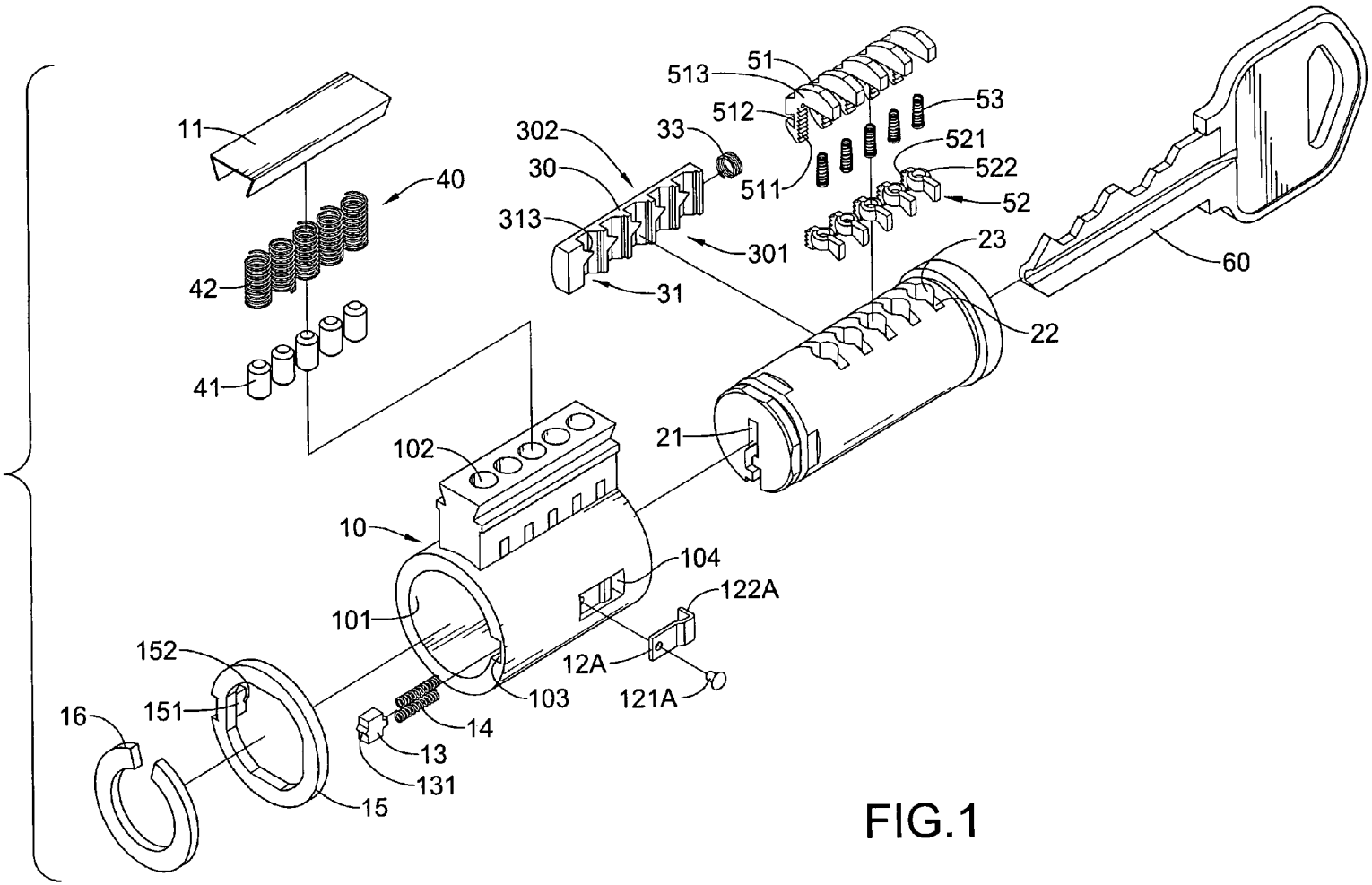
FIG. 1 is an exploded perspective view of a first embodiment of a lock assembly in accordance with the present invention.
Figure 2:
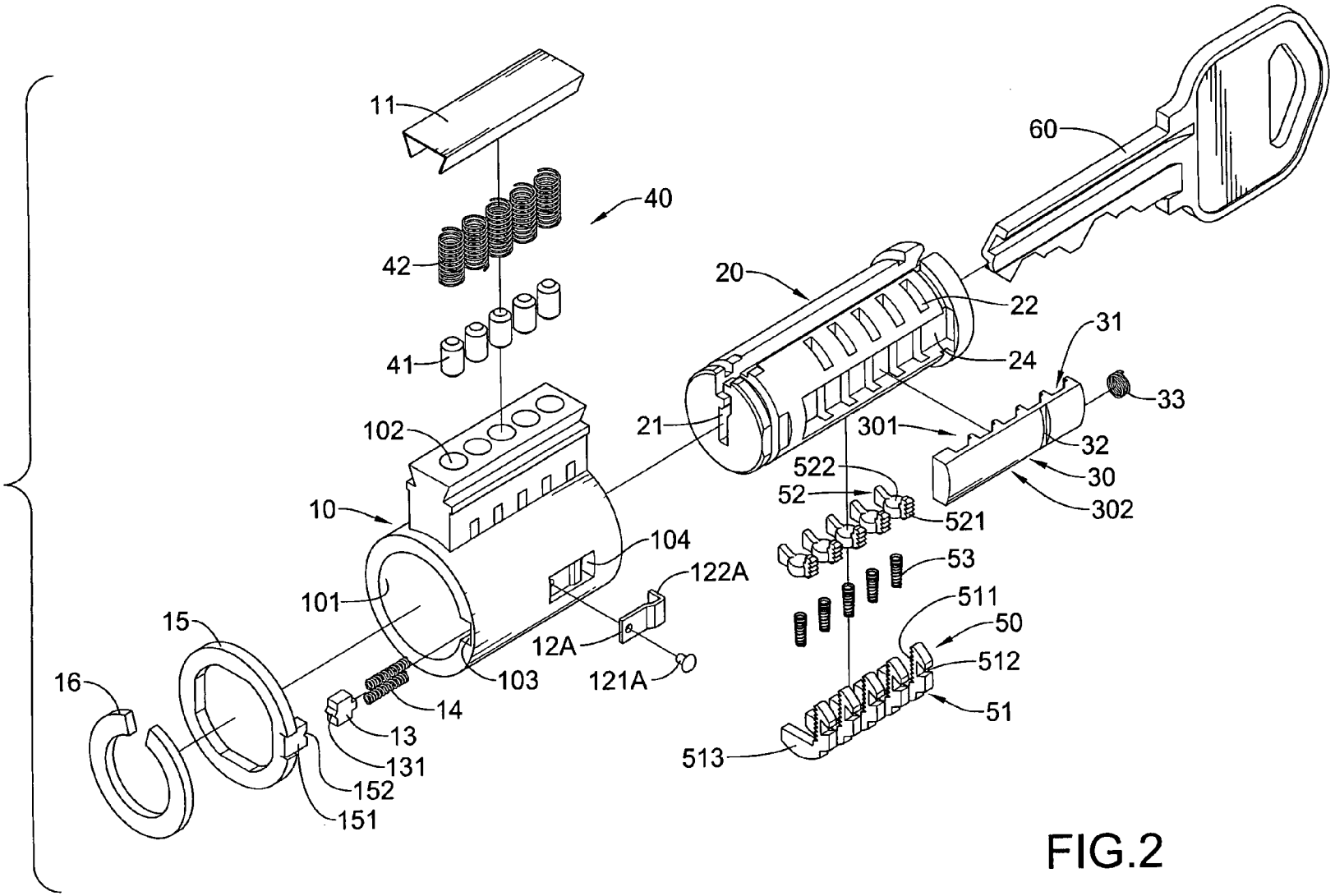
FIG. 2 is another exploded perspective view of the lock assembly in FIG. 1.
Figure 3:
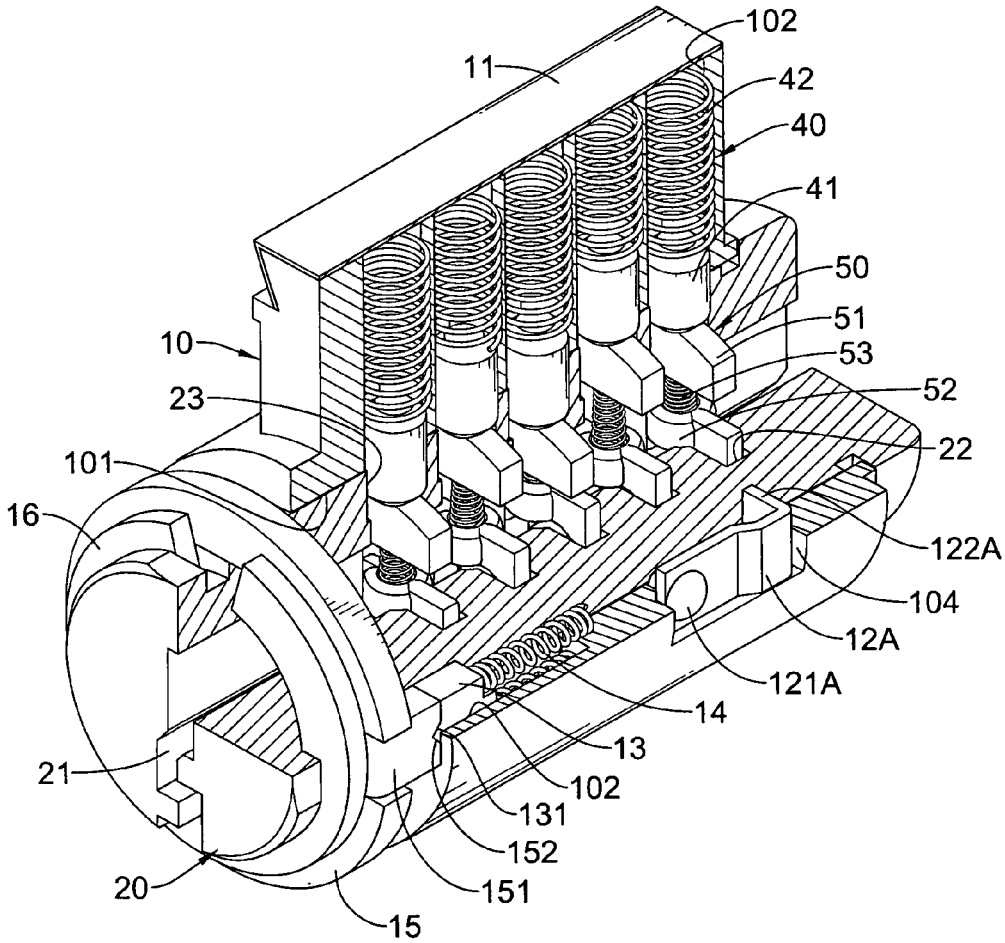
FIG. 3 is a perspective view in partial section of the lock assembly in FIG. 1.

With reference to FIGS. 1 to 3, a lock assembly in accordance with the present invention comprises a housing (10), a lock cylinder (20), an adjusting block (30), an engaging member (12A), multiple pin assemblies (40) and multiple rack assemblies (50).

The housing (10) has a cylinder hole (101), multiple pin holes (102), a lid (11), a through hole (104) and a positioning element (13).

The cylinder hole (101) is defined axially through the housing (10). The pin holes (102) are defined radially in the housing (10) and communicate with the cylinder hole (101). The lid (11) is attached to the housing (10) and closes the pin holes (102). The through hole (104) is defined radially in the housing (10) and communicates with the cylinder hole (101).

The positioning element (13) is mounted on and extends from the housing (10). In a first embodiment, an alignment channel (103) is defined in an inner surface of the cylinder hole (101) at a rear end of the housing (10), and the positioning element (13) is slidably mounted in and extends out of the alignment channel (103). At least one spring (14) is mounted in the alignment channel (103) and abuts the positioning element (13) to push the positioning element (13) out of the alignment channel (103). The positioning element (13) may have a positioning tip (131) formed on and protruding from the positioning element (13).

Figure 5:
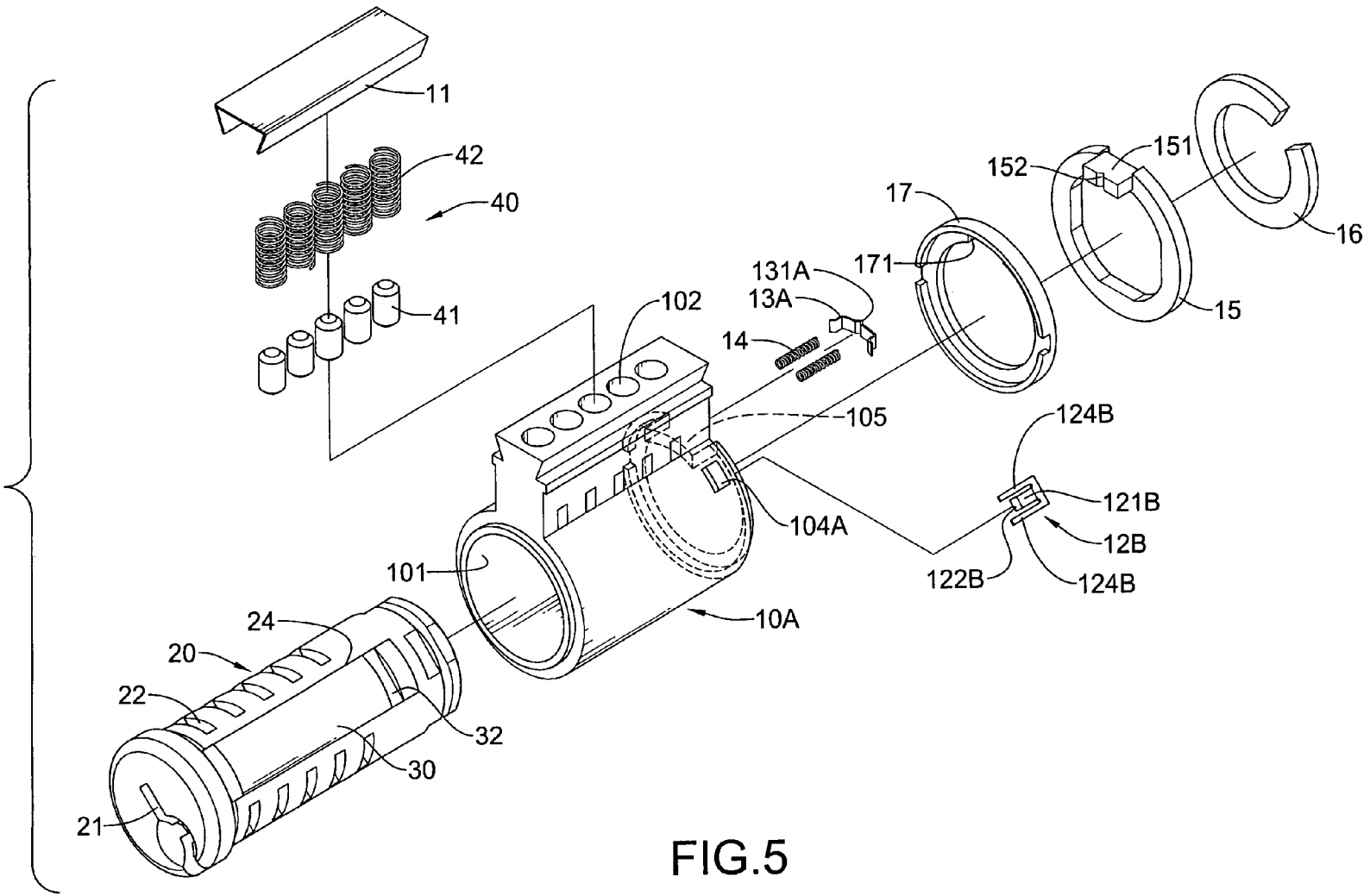
FIG. 5 is an exploded perspective view of a second embodiment of a lock assembly in accordance with the present invention.
Figure 6:
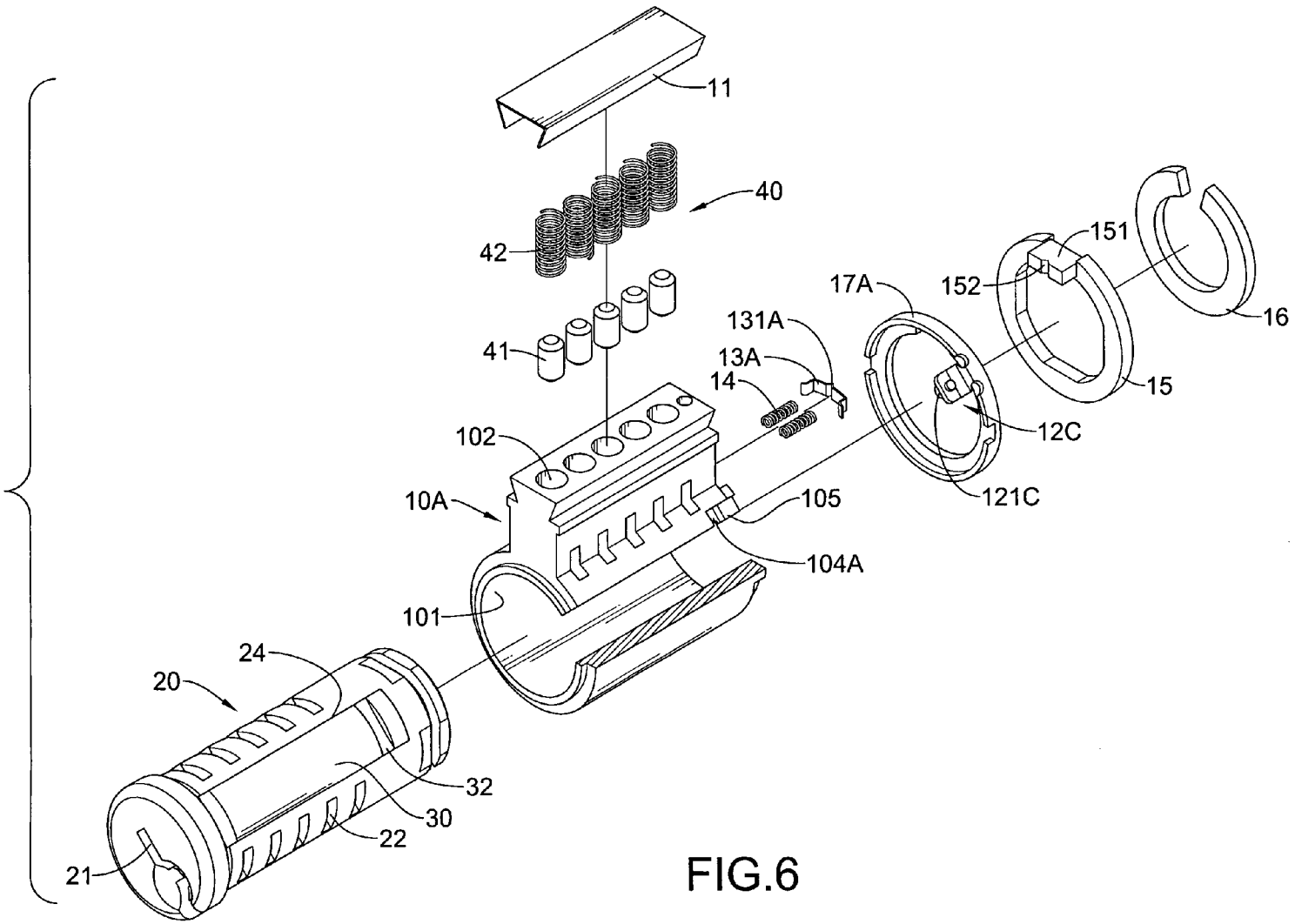
FIG. 6 is an exploded perspective view in partial section of a third embodiment of a lock assembly in accordance with the present invention.
Figure 7:
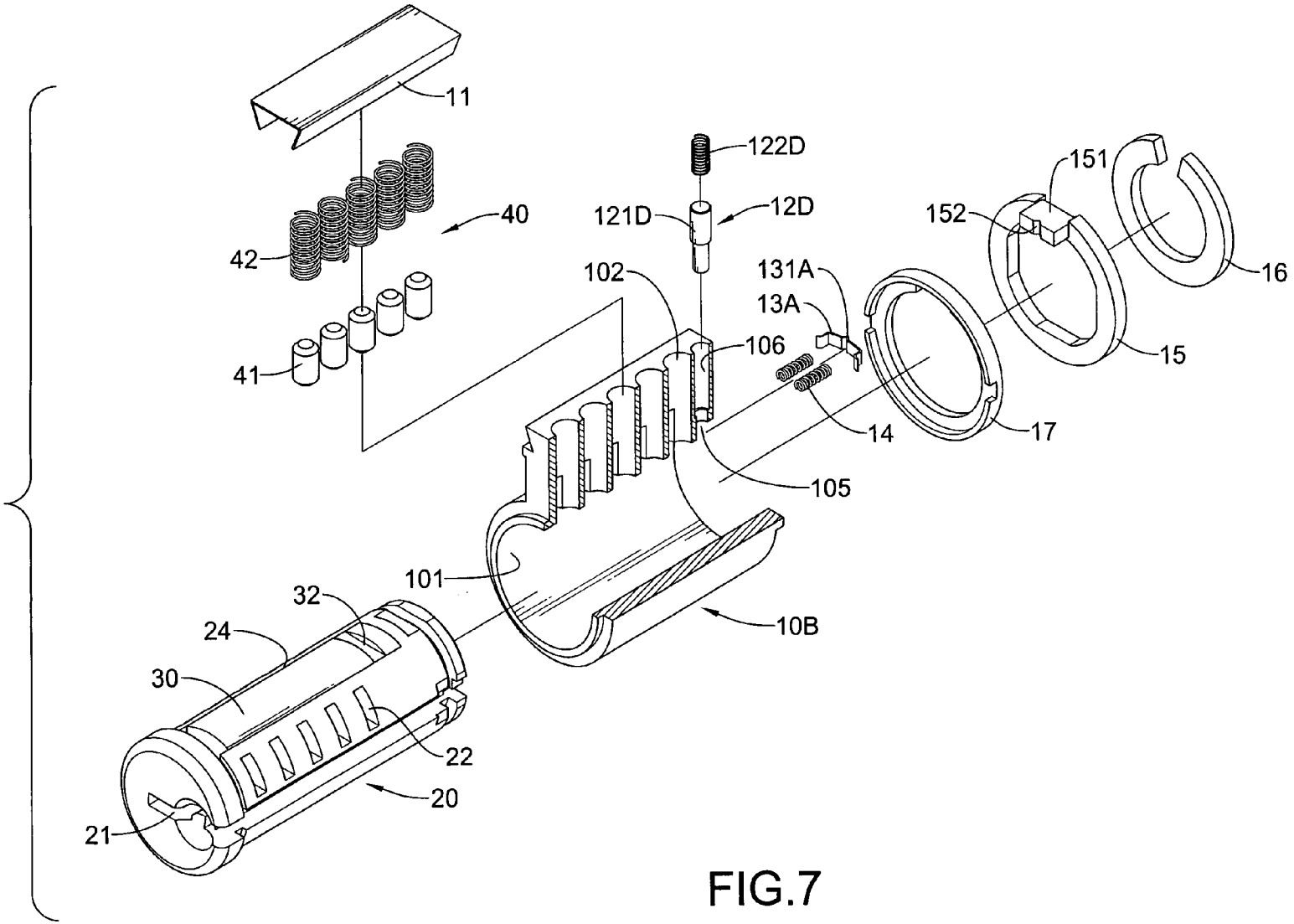
FIG. 7 is an exploded perspective view in partial section of a fourth embodiment of a lock assembly in accordance with the present invention.

With reference to FIGS. 5 to 7, in an alternative embodiment, an alignment notch (105) is defined in a rear end of the housing (10A,10B), and the positioning element (13A) is mounted in and extends out of the alignment notch (105) and has a positioning tip (131A). Additionally, the housing (10A, 10B) further has an annular cap (17,17A) mounted on a rear end of the housing (10A,10B) and is made of wear-resisting material. The annular cap (17,17A) has an aligning notch (171) aligning with the alignment channel (103) or the alignment notch (105) in the housing (10,10A,10B).

The lock cylinder (20) is rotatably and slidably mounted in the cylinder hole (101) in the housing (10) and comprises a key hole (21), multiple pin slots (22), a holding recess (24), a positioning collar (15) and a fastener (16).

The key hole (21) is defined axially through the lock cylinder (20). The pin slots (22) are defined radially in the lock cylinder (20), communicate with the key hole (21) and selectively and respectively correspond to and align with the pin holes (102) in the housing (10). Each pin slot (22) further has a pin bore (23) defined in an inner surface of the pin slot (22) and having a diameter larger than a width of the pin slot (22). The holding recess (24) is longitudinally defined in the lock cylinder (20) and communicates with the pin slots (22). The positioning collar (15) is mounted securely around and rotated with the lock cylinder (20) at a rear end, may abut the annular cap (17,17A) and has a positioning portion (151). With the wear-resisting annular cap (17,17A), the positioning collar (15) is kept from contacting with the rear end of the housing (10), such that the housing (10) is prevented from being worn off. The positioning portion (151) is formed on and protrudes from the positioning collar (15) and selectively engages the positioning element (13) in the alignment channel (103) of the housing (10). The positioning portion (151) may have a positioning detent (152) defined in the positioning portion (151) at an end facing the positioning element (13) and selectively engaging the positioning tip (131) on the positioning element (13) via the aligning notch (171) in the annular cap (17).

The fastener (16) is C-shaped or E-shaped and attached to a rear end of the lock cylinder (20) and abuts the positioning collar (15) to keep the lock cylinder (20) from escaping from the cylinder hole (101) in the housing (10).

The adjusting block (30) is slidably mounted on the lock cylinder (20), is preferably mounted in the holding recess (24) and has a wedge side (301), an engaging side (302), multiple first wedge elements (31) and an engaging slot (32).

The wedge side (301) faces the lock cylinder (20), and the engaging side (302) is opposite to the wedge side (301). The first wedge elements (31) are formed on the wedge side (301) and correspond respectively to the pin slots (22) in the lock cylinder (20).

Figure 8:
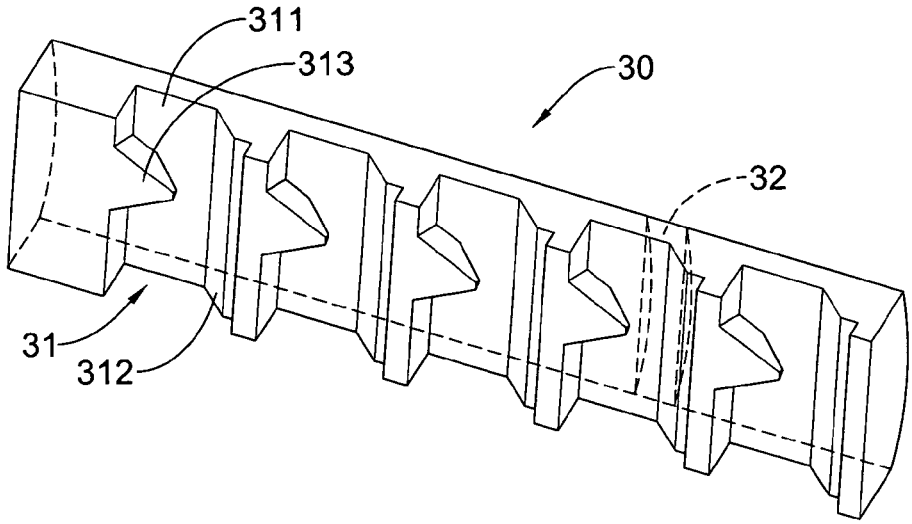
FIG. 8 is a perspective view of a first embodiment of an adjusting block of a lock assembly in accordance with the present invention.
Figure 9:
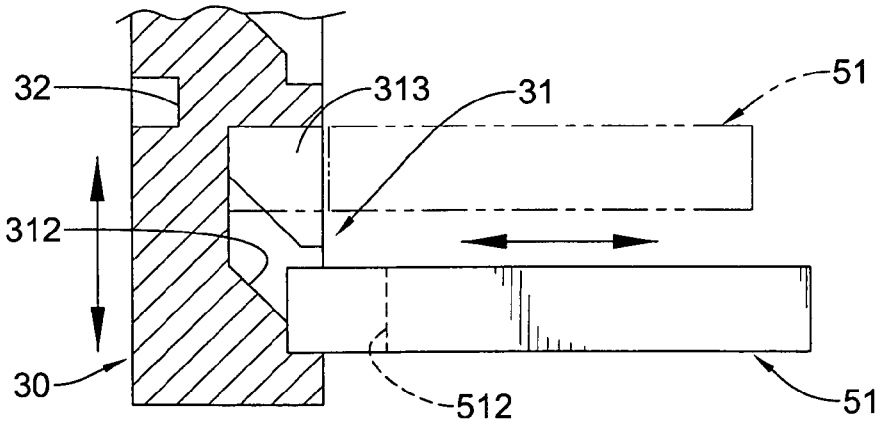
FIG. 9 is an operational top view in partial section of the adjusting block in FIG. 8 with a corresponding supporting member.

With further reference to FIGS. 8 and 9, in a first embodiment, each first wedge element (31) on the adjusting block (30) comprises a recess (311), an inclined guiding face (312) and a wedge tip (313). The recess (311) is defined in the wedge side (301) of the adjusting block (30) and has a front side and a rear side. The inclined guiding face (312) is defined in the front side of the recess (311). The wedge tip (313) is formed on the rear side of the recess (311), extends toward the front side and has two inclined wedge surfaces.

Figure 10:
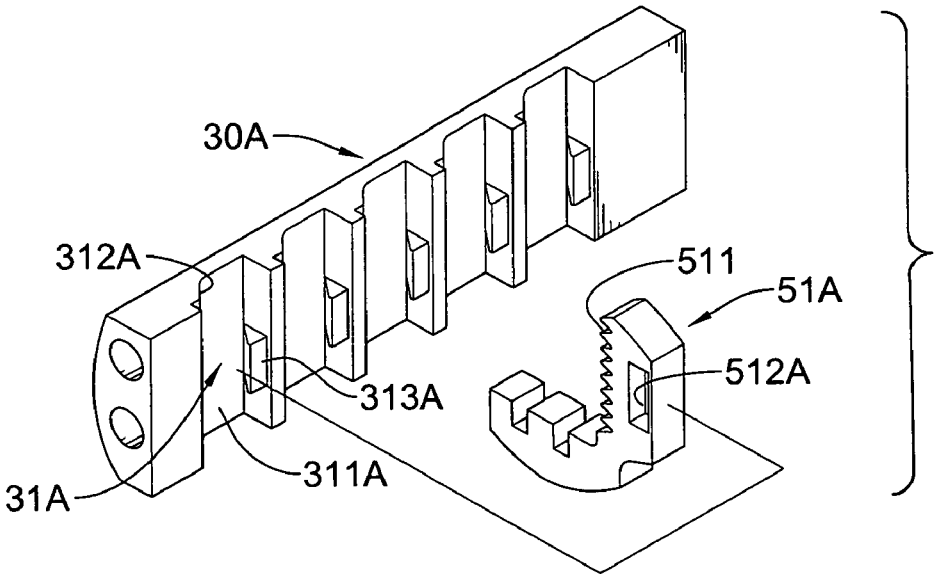
FIG. 10 is an exploded perspective view of a second embodiment of an adjusting block and a supporting member of a lock assembly in accordance with the present invention.
Figure 12A:
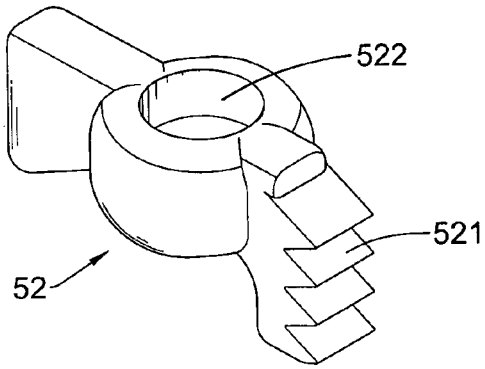
FIGS. 12A to C are perspective views of embodiments of an adjusting base of a lock assembly in accordance with the present invention.
Figure 12B:
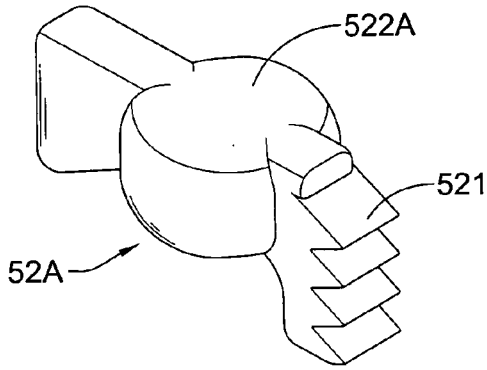
Figure 12C:
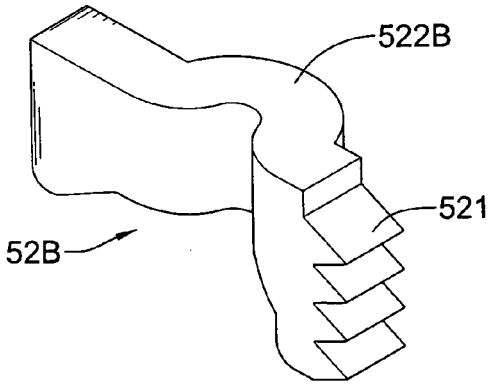

With reference to FIGS. 10 and 12, in a second embodiment, each first wedge element (311A) on the adjusting block (30A) comprises a recess (311A), an inclined guiding face (312A) and a wedge boss (313A). The recess (311A) is defined in the wedge side (301) of the adjusting block (30A) and has a front side and a rear side. The inclined guiding face (312A) is defined in the front side of the recess (311A). The wedge boss (313A) is formed on the rear side of the recess (311A) and has an inclined wedge surface (313A).

The engaging slot (32) is defined in the engaging side (302) of the adjusting block (30). Additionally, a biasing member (33), such as a spring is mounted in the holding recess (24) and abuts the adjusting block (30).

The engaging member (12A) is mounted on the housing (10) and extends into the cylinder hole (101) through the through hole (104).

In the first embodiment, with reference to FIGS. 1 to 3, the through hole (104) is defined in the housing (10) near a front end of the housing (10). The engaging member (12A) is a resilient strap and has a connecting end and an engaging end (122A). The connecting end is securely mounted on the housing (10) with a fastener (121A). The engaging end (122A) is bent from the connecting end, extends into the cylinder hole (101) through the through hole (104) in the housing (10) and detachably and selectively engages the engaging slot (32) in the adjusting block (30).

In a second embodiment, with reference to FIG. 5, the through hole (104A) is defined in the housing (10A) near a rear end of the housing (10A). The engaging member (12B) is a resilient strap, is attached to the rear end of the housing (10A) and has an engaging tab (121B) and two legs (124B). The engaging tab (112B) comprises an engaging end (122B) bent from one end of the engaging tab (121B), extending into the cylinder hole (101) through the through hole (104A) and selectively engaging the engaging slot (32) in the adjusting block (30). The legs (124B) are formed respectively on two sides of and being parallel with the engaging tab (121B) and extend into the cylinder hole (101) from the rear end of the housing (10A).

In a third embodiment, with reference to FIG. 6, the engaging member (12C) is formed on and protrudes from the annular cap (17A) and has a resilient tab and an engaging boss (121C). The resilient tab is formed on and protrudes from the annular cap (17A). The engaging boss (121C) is formed on the resilient tab, extends into the cylinder hole (101) through the through hole (104A) in the housing (10A) and selectively engaging the engaging slot (32) in the adjusting block (30).

In a fourth embodiment, with reference to FIG. 7, the through hole (106) is defined in the housing (10B) near a rear end of the housing (10B) and aligns with the pin holes (102) in the housing (10B). The engaging member (12D) is mounted in the through hole (106) and has an engaging stud (121D) and a spring (122D). The engaging stud (121D) is mounted in the through hole (106), extends into the cylinder hole (101) and selectively engages the engaging slot (32) in the adjusting block (30). The spring (122D) is mounted in the through hole (106) and abuts and pushes the engaging stud (121D).

The lock pin assemblies (40) are mounted respectively in the pin holes (102) in the housing (10) and selectively extend respectively into the pin slots (22) in the lock cylinder (20), preferably extend into the pin bores (23) in the pin slots (22).

Each lock pin assembly (40) comprises a lock pin (41) and a spring (42). The lock pin (41) is slidably mounted in one of the pin holes (102) in the housing (10) and selectively extends into the pin bore (23) of a corresponding one the pin slots (22) in the lock cylinder (20). The spring (42) is held in a corresponding pin hole (102) and abuts against the lock pin (41) and the lid (11) to push the lock pin (41) into the corresponding pin slot (22).

The rack assemblies (50) are mounted respectively in the pin slots (22) in the lock cylinder (20) to support the lock pins (41) of the lock pin assemblies (40). Each rack assembly (50) comprises a rack element (51), an adjusting base (52) and a resilient member (53). The rack element (51) may be L-shaped, is slidably mounted in one of the pin slots (22), selectively abuts with and supports a corresponding one of the lock pins (41) and has an extension arm (513), multiple teeth (511) and a second wedge element (512). The extension arm (513) is formed on and extends laterally from the top of the rack element (51). The teeth (511) and the second wedge element (512) are formed respectively at two sides of the rack element (51). The second wedge element (512) selectively engages one of the first wedge elements (31) on the adjusting block (30).

With further reference to FIG. 9, in a first embodiment, the second wedge element (512) on each rack element (51) comprises a notch defined in the second wedge element (512) at a side facing the adjusting block (30). The notch has two inclined wedge surfaces selectively abutting respectively with the inclined wedge surfaces of the wedge tip (313) on a corresponding first wedge element (31) on the adjusting block (30).

Figure 11:
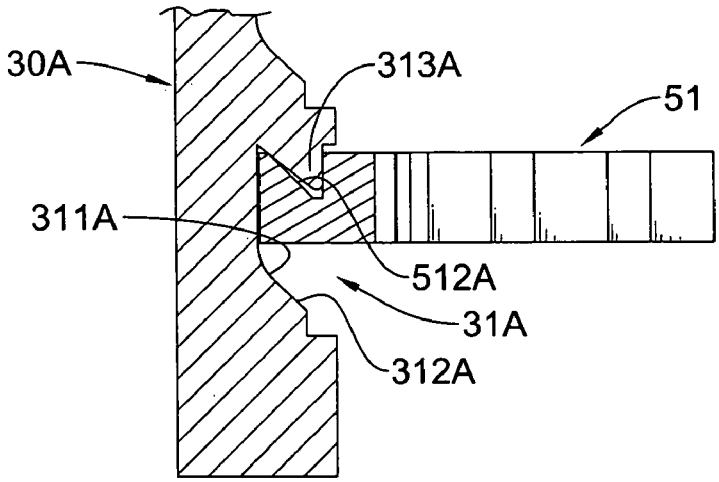
FIG. 11 is an operational top view in partial section of the adjusting block and the corresponding supporting member in FIG. 10.

With further reference to FIGS. 10 and 11, in a second embodiment, the second wedge element (512A) on each rack element (51A) comprises a notch defined in the wedge element (51A) at a side facing the adjusting block (30A). The notch has an inclined wedge surface selectively abutting with the inclined wedge surface of the wedge boss (313A) on a corresponding first wedge element (31A) on the adjusting block (30A).

The adjusting base (52) is slidably mounted in a corresponding pin slot (22) and has multiple teeth (521) engaging the teeth (511) on the rack element (51) and a spring abutting portion (522). With the engagement between the teeth (511, 521) on the rack element (51) and the adjusting base (52), the rack element (51) will move with the adjusting base (52) along the corresponding pin slot (22). The spring abutting portion (522) is formed on the adjusting base (52). In a first embodiment, with reference to FIG. 12A, the spring abutting portion (522) is a round cavity defined in the adjusting base (52). In a second embodiment, with reference to FIG. 12B, the spring abutting portion (522A) is a round block formed on a middle of the adjusting base (52A). In a third embodiment, with reference to FIG. 12C, the spring abutting portion (522B) is a C-shaped formed on a middle of the adjusting base (52B).

The resilient member (53) is mounted between the rack element (51) and the adjusting base (52). In a preferred embodiment, two ends of the resilient member (53) abut respectively with the extension arm (513) and the spring abutting portion (522) on the adjusting base (52).

Figure 13:
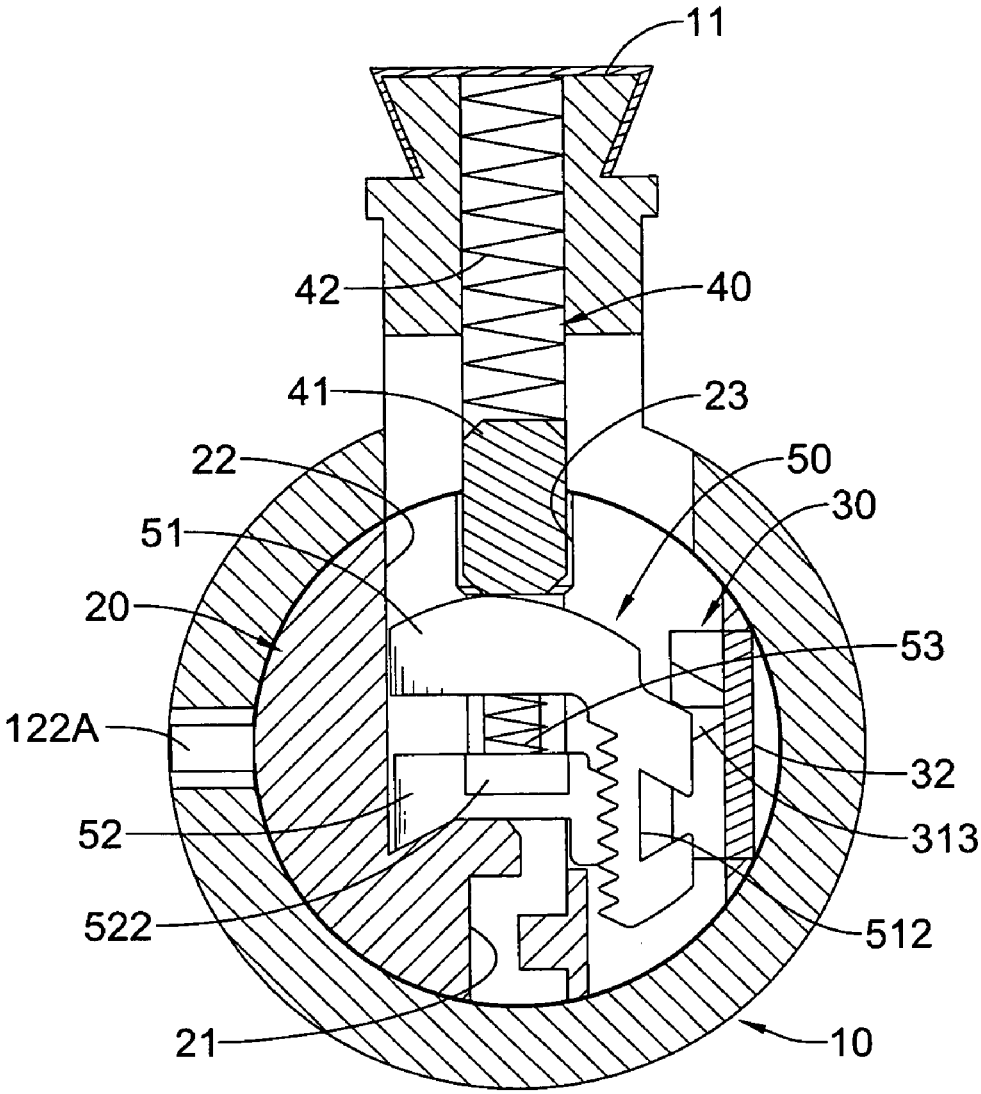
FIG. 13 is a side view in partial section of the lock assembly in FIG. 1 showing that the lock assembly is in a locked condition.

In use, with reference to FIGS. 3 and 13, before a specific key is inserted into the key hole (21), the lock pins (41) extend respectively into the pin bores (23) of the lock slots (22) in the lock cylinder (20). Thus, the interface between the housing (10) and the lock cylinder (20) is blocked by the lock pins (41) to keep the lock cylinder (20) from rotating relative to the housing (10), and the lock assembly is in a lock condition.

Figure 4:
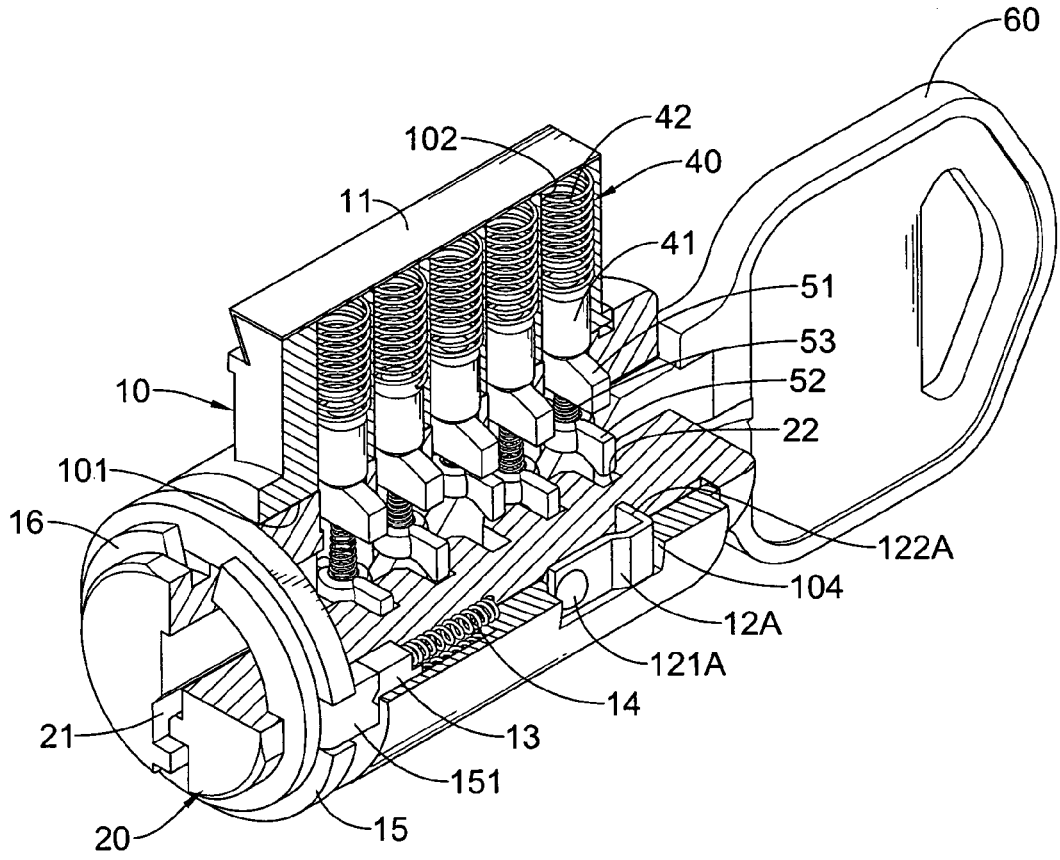
FIG. 4 is a perspective view in partial section of the lock assembly in FIG. 1 with a key being inserted into the lock cylinder.

When a specific key (60) is inserted into the key hole (21), with reference to FIG. 4, the key pushes the adjusting bases (52) with the rack elements (51) to move upward along the pin slots (22) to a position where the joints between the lock pins (41) and the rack elements (51) align with the interface between the lock cylinder (20) and the housing (10). Consequently, the lock cylinder (20) can be rotated, and the lock assembly is in an unlocked condition.

Figure 14A:
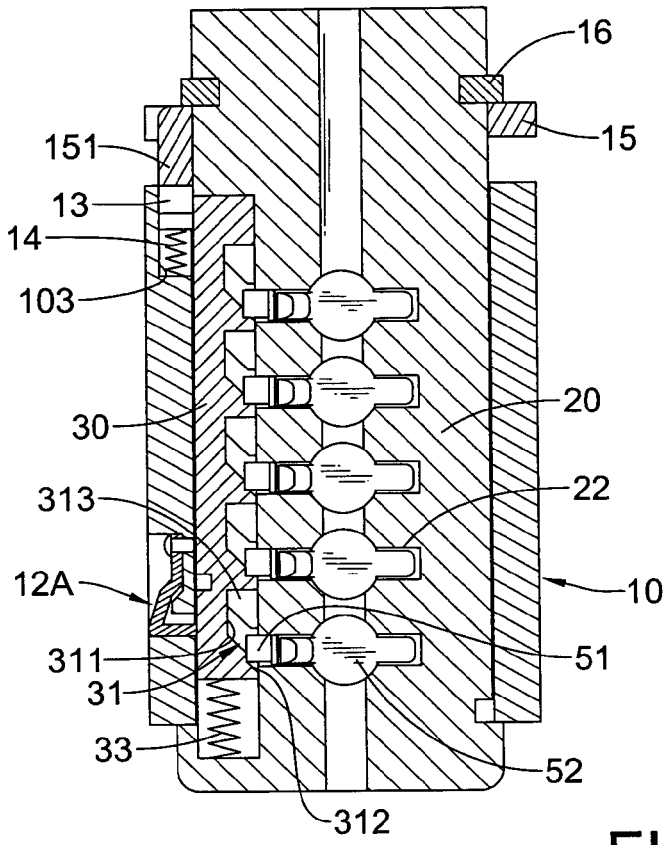
FIGS. 14A, 14B, 15A, 15B, 16A, 16B, 17A, 17B, 18A, 18B, 19A and 19B are top and side views in partial section of the lock assembly in FIG. 1 showing the process of the lock assembly being adjusted to fit with different keys.
Figure 14B:
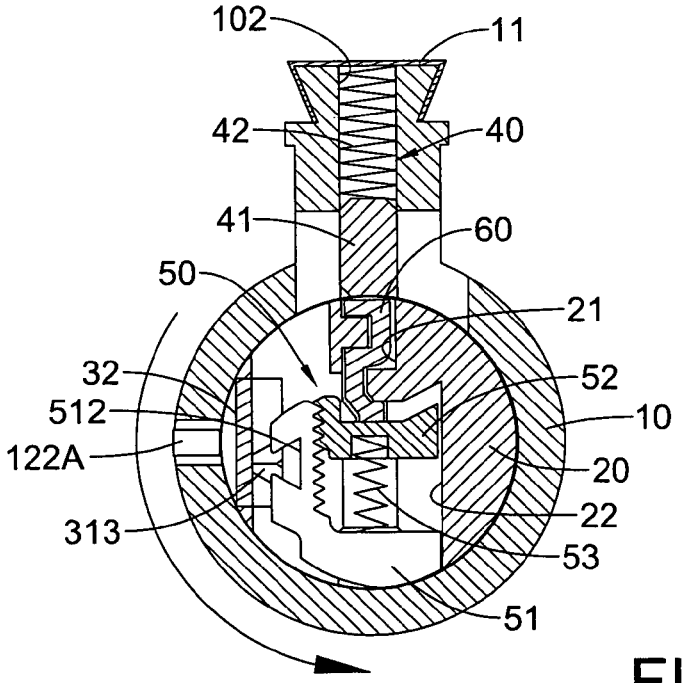

To adjust the lock assembly to fit with different keys, with reference to FIGS. 14 to 19, a first key (60) is inserted into the key hole (21) to unlock the lock assembly, and the lock cylinder (20) is then rotated to a position where the engaging slot (32) in the adjusting block (30) corresponds to and aligns with the engaging device (12A) as shown in FIGS. 14A and B. Additionally, the positioning collar (15) is rotated with the lock cylinder (20) to align and engage the positioning element (13). With the engagement between the positioning portion (151) on the positioning collar (15) and the positioning element (13), the necessary rotating angle of the lock cylinder (20) for aligning the adjusting block (30) with the engaging device (12A) is determined.

Figure 15A:
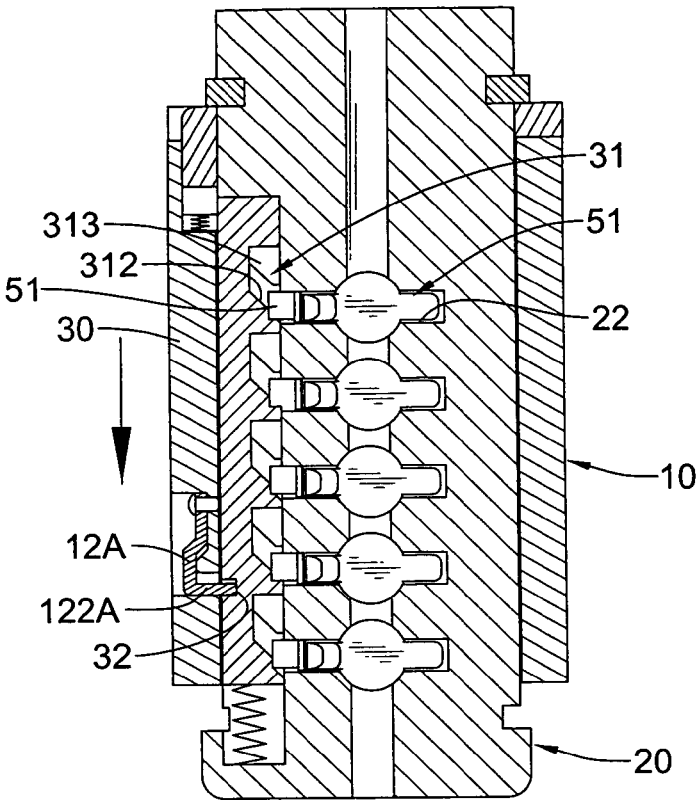
Figure 15B:
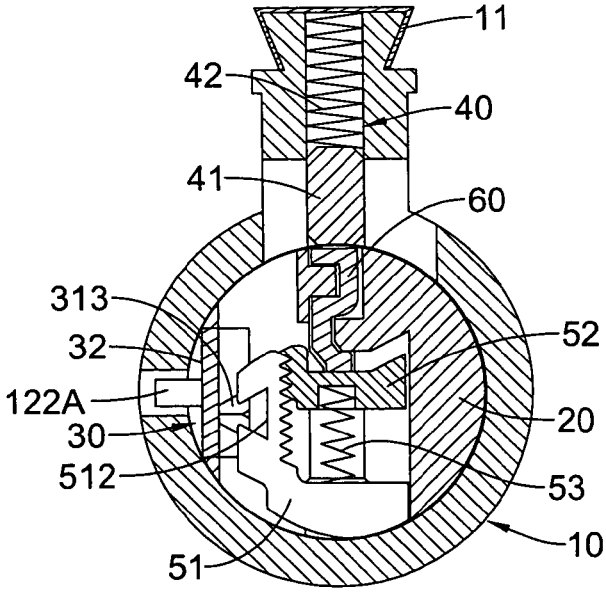

The lock cylinder (20) is moved, such as pulled to slide in the cylinder hole (101) to make the engaging device (12A) engaging the engaging slot (32) in the adjusting block (30) as shown in FIGS. 15A and B. With the engagement between the device (12A) and the slot (32), the adjusting block (30) is kept from moving with the lock cylinder (20).

Figure 16A:
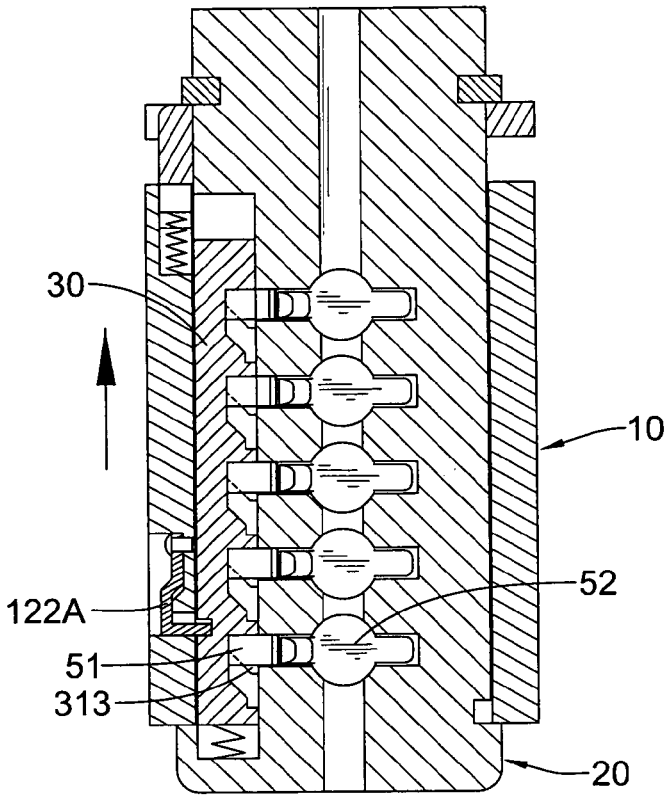
Figure 16B:
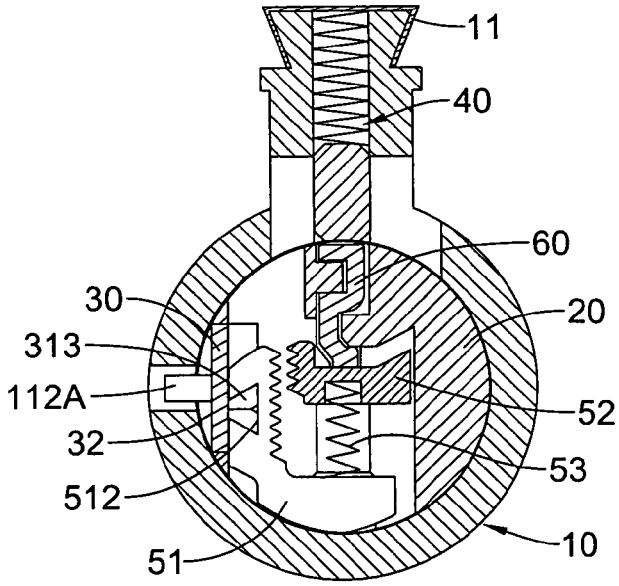

The lock cylinder (20) is then moved, such as pushed, the adjusting block (30) is kept stationary and the rack elements (51) are moved with the lock cylinder (20) and relative to the adjusting block (30). Consequently, the rack elements (51) will move away from the adjusting bases (52) with the inclined surfaces (312) of the first wedge elements (31) on the adjusting block (30) as shown in FIGS. 9 and 11. Thus, the rack elements (51) are disengaged from the adjusting bases (52) as shown in FIGS. 16A and B.

Figure 17A:
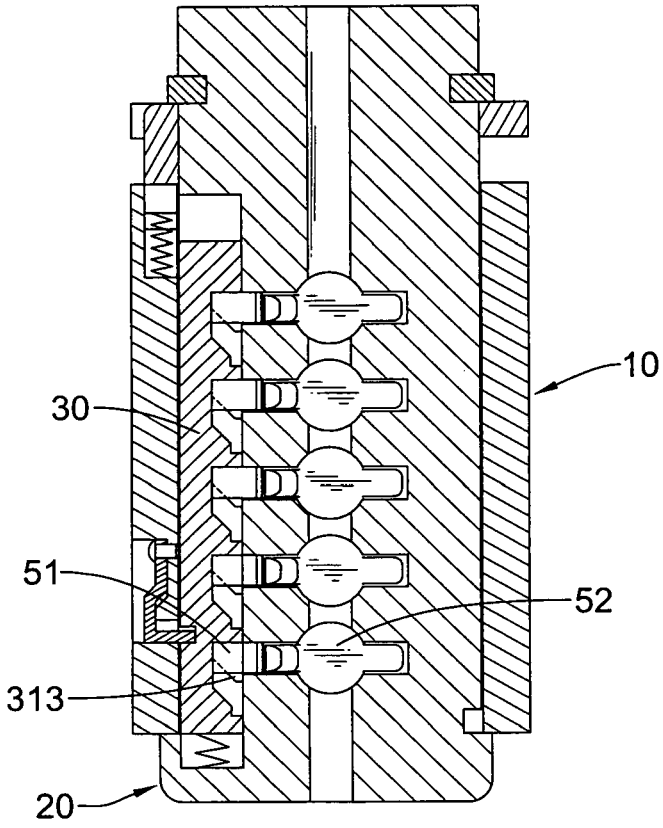
Figure 17B:
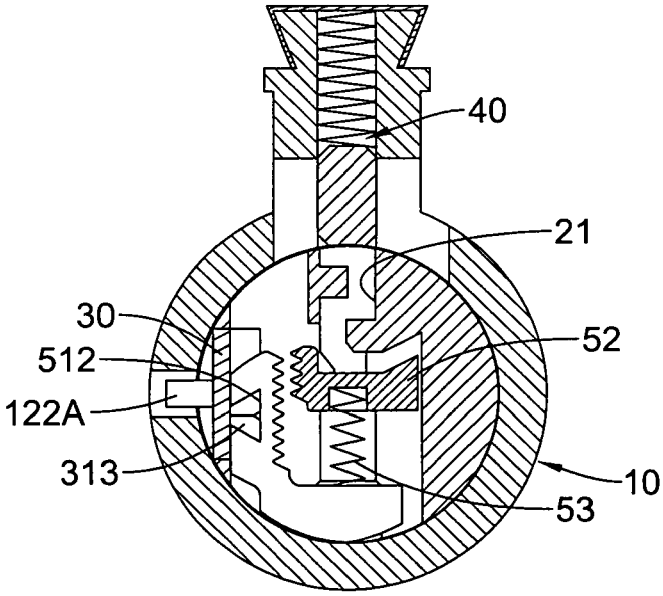

The first key (60) is removed from the key hole (21), as shown in FIGS. 17 A and B.

Figure 18A:
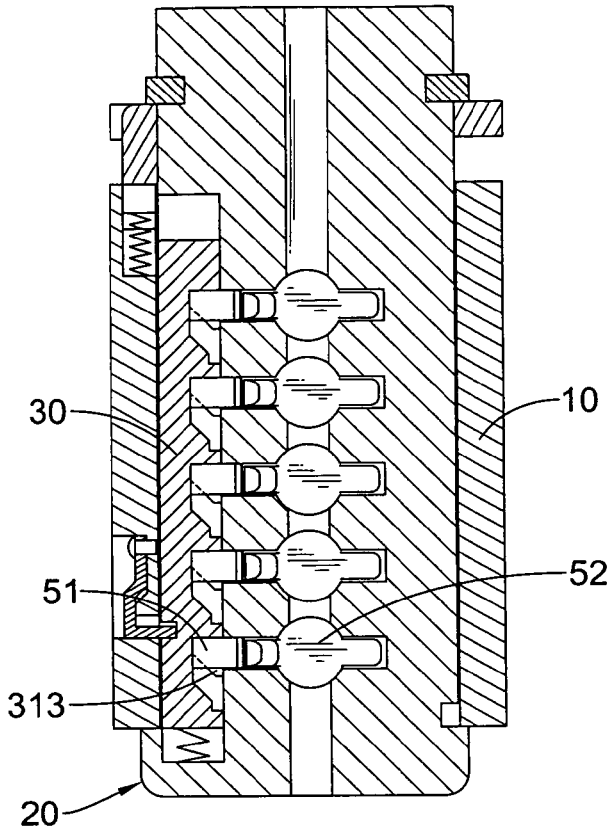
Figure 18B:
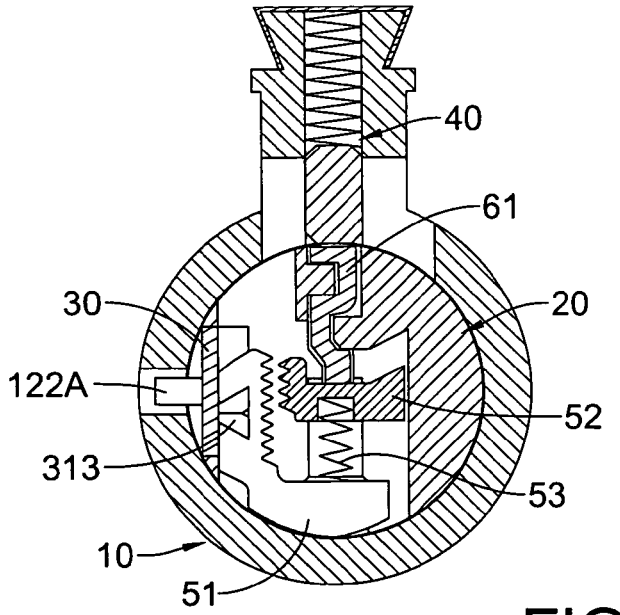

A second key (61) is then inserted into the key hole (21) to support the adjusting bases (52) at different positions from those supported by the first key (60) as shown in FIGS. 18 A and B.

Figure 19A:
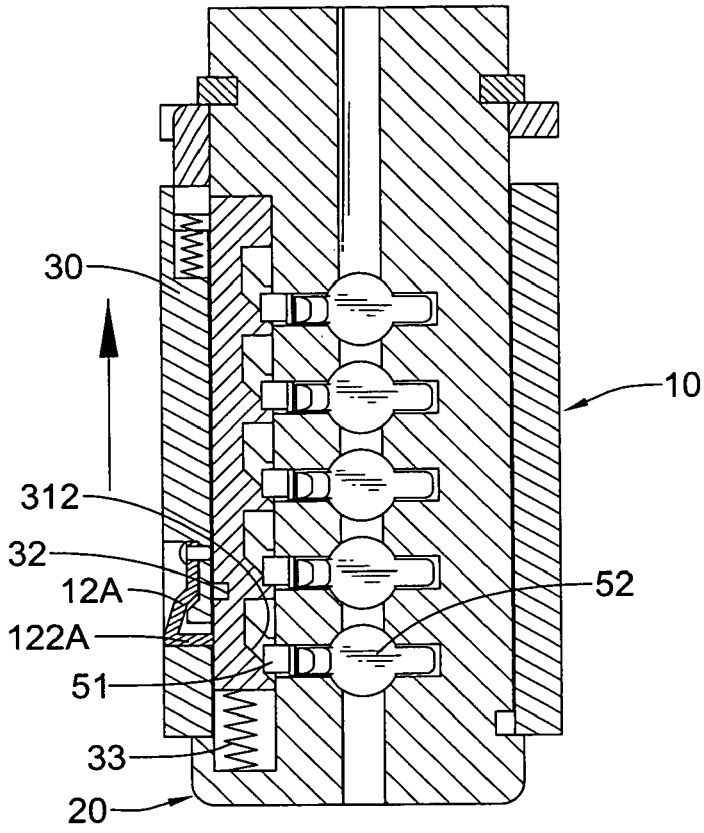
Figure 19B:
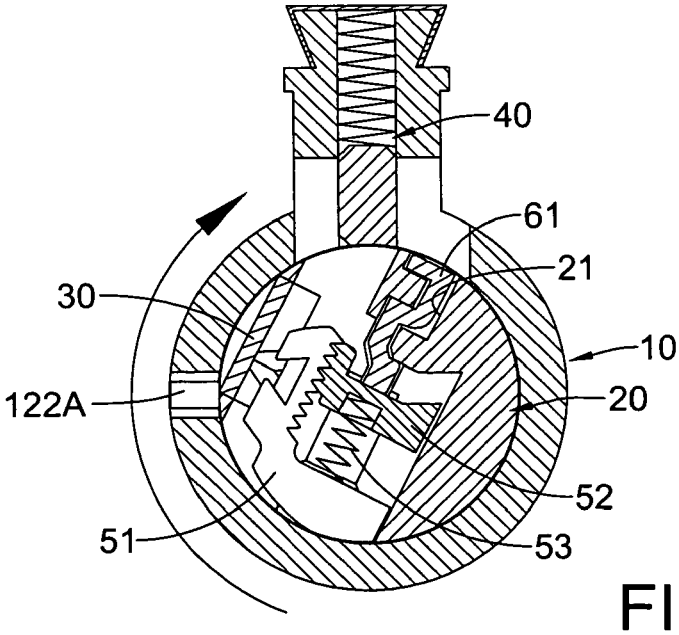

Finally, the lock cylinder (20) is rotated by the second key (61) as shown in FIGS. 19A and B. With the rotation of the lock cylinder (20), the adjusting block (30) will disengage from the engaging device (12A) and move to an original position with the force provided by the biasing member (33). With the movement of the adjusting block (30), the rack elements (51) are pushed to move close to and engage the adjusting bases (52). Because the adjusting bases (52) are located at different positions, the teeth (521) on the adjusting bases (52) engage different teeth (511) on the rack elements (51). Thus, the rack elements (51) support the lock pins (41) at different positions to fit with the second key (61).

Accordingly, to adjust the lock assembly in accordance with the present invention is convenient and quick without using any tool, so that the lock assembly is versatile in use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lock assembly comprising:

a housing having a cylinder hole defined axially through the housing;

a lock cylinder rotatably and slidably received in the cylinder hole of the housing and having a key hole, a plurality of pin slots and a holding recess, wherein the pin slots and the holding recess are communicating with the key hole of the lock cylinder;

an adjusting block slidably received in the holding recess of the lock cylinder and having a wedge side facing the lock cylinder and a plurality of first wedge elements formed on the wedge side; and a plurality of rack assemblies slidably received respectively in the pin slots in the lock cylinder, each rack assembly comprising a rack element, an adjusting base and a resilient member arranged between the rack element and the adjusting base, wherein each rack element and each adjusting base have a plurality teeth formed thereon and detachably engaging each other respectively, and each rack element has a second wedge element that is selectively engaged or disengaged from one of the first wedge elements on the adjusting block.

2. The lock assembly as claimed in claim 1, wherein each first wedge element on the adjusting block comprises a recess defined in the wedge side of the adjusting block and having a front side and a rear side;

an inclined guiding face defined in the front side of the recess; and a wedge tip formed on the rear side of the recess and having two inclined wedge surfaces;

the second wedge element on the rack element of each rack assembly comprises a notch defined in the second wedge element and having two inclined wedge surfaces selectively abutting respectively with the inclined wedge surfaces of the wedge tip on a corresponding first wedge element on the adjusting block.

3. The lock assembly as claimed in claim 1, wherein each first wedge element on the adjusting block comprises a recess defined in the wedge side of the adjusting block and having a front side and a rear side;

an inclined guiding face defined in the front side of the recess; and a wedge boss formed on the rear side of the recess and having an inclined wedge surface;

the second wedge element on the rack element of each rack assembly comprises a notch defined in the second wedge element and having an inclined wedge surface selectively abutting with the inclined wedge surface of the wedge boss on a corresponding first wedge element on the adjusting block.

4. The lock assembly as claimed in claim 1, wherein the rack element of each rack assembly further has an extension arm formed on and extending laterally from a top of the rack element;

the adjusting base of each rack assembly further has a spring abutting portion formed on the adjusting base; and the resilient member of each rack assembly has two ends abutting respectively the extension arm of the rack element and the spring abutting portion on the adjusting base of the rack assembly.

5. The lock assembly as claimed in claim 4, wherein the spring abutting portion on the adjusting base of each rack assembly is a round block.

6. The lock assembly as claimed in claim 4, wherein the spring abutting portion on the adjusting base of each rack assembly is a round cavity defined in the adjusting base.

7. The lock assembly as claimed in claim 4, wherein the spring abutting portion on the adjusting base of each rack assembly is C-shaped.

8. The lock assembly as claimed in claim 1, wherein the housing has multiple pin holes defined radially in the housing and communicating with the cylinder hole; and a lid attached to the housing and closing the pin holes;

the lock assembly further has multiple lock pin assemblies mounted respectively in the pin holes in the housing, selectively extending respectively into the pin slots in the lock cylinder and each comprising a lock pin slidably mounted in one of the pin holes in the housing and selectively extending into a corresponding one the pin slots in the lock cylinder; and a spring held in a corresponding pin hole and abutting against the lock pin and the lid on the housing; and the rack elements selectively abut respectively with and support the lock pins.

9. The lock assembly as claimed in claim 8, wherein the housing further has a through hole defined in the housing near a rear end of the housing;

the lock assembly further has an engaging member mounted in the through hole in the housing and having an engaging stud mounted in the through hole in the housing and extending into the cylinder hole through the through hole in the housing; and a spring mounted in the through hole in the housing and abutting the engaging stud; and the adjusting block further has an engaging side opposite to the wedge side; and an engaging slot defined in the engaging side and selectively engaging the engaging stud.

10. The lock assembly as claimed in claim 9, wherein a biasing member is mounted in the holding recess and abuts the adjusting block.

11. The lock assembly as claimed in claim 1, wherein the housing further has an alignment channel defined in an inner surface of the cylinder hole at a rear end of the housing;

a positioning element slidably mounted in and extending out of the alignment channel; and at least one spring mounted in the alignment channel and abutting the positioning element; and a positioning collar is mounted securely around and rotated with the lock cylinder and has a positioning portion formed on and protruding from the positioning collar and selectively engaging the positioning element in the alignment channel of the housing.

12. The lock assembly as claimed in claim 11, wherein the positioning element has a positioning tip formed on and protruding from the positioning element at an end facing the positioning collar; and the positioning portion on the positioning collar has a positioning detent defined in the positioning portion at an end facing the positioning element and selectively engaging the positioning tip on the positioning element.

13. The lock assembly as claimed in claim 11, wherein the lock cylinder further has a fastener attached to the rear end of the lock cylinder and abutting the positioning collar to keep the lock cylinder from escaping from the housing.

14. The lock assembly as claimed in claim 1, wherein the adjusting block further has an engaging side opposite to the wedge side; and an engaging slot defined in the engaging side; and the lock assembly further has an engaging member mounted on the housing, extending into the cylinder hole and selectively engaging the engaging slot in the adjusting block.

15. The lock assembly as claimed in claim 14, wherein the housing further has an annular cap mounted on a rear end of the housing.

16. The lock assembly as claimed in claim 15, wherein the housing further has a through hole defined in the housing near the rear end of the housing;

the engaging member is formed on and protrudes from the annular cap and has a resilient tab formed on and protruding from the annular cap; and an engaging boss formed on the resilient tab, extending into the cylinder hole through the through hole in the housing and selectively engaging the engaging slot in the adjusting block.

17. The lock assembly as claimed in claim 14, wherein the housing further has a through hole defined in the housing near a rear end of the housing; and the engaging member is a resilient strap and has a connecting end securely mounted on the housing with a fastener;

an engaging end bent from the connecting end, extending into the cylinder hole through the through hole in the housing and selectively engaging the engaging slot in the adjusting block.

18. The lock assembly as claimed in claim 14, wherein the housing further has a through hole defined in the housing near a rear end of the housing;

the engaging member is a resilient strap, is attached to the rear end of the housing and has an engaging tab comprising an engaging end bent from one end of the engaging tab, extending into the cylinder hole through the through hole in the housing and selectively engaging the engaging slot in the adjusting block; and two legs formed respectively on two sides of and being parallel with the engaging tab and extending into the cylinder hole in the housing.

* * * * *